US006484621B1

(12) United States Patent
Kato et al.

(10) Patent No.: US 6,484,621 B1
(45) Date of Patent: Nov. 26, 2002

(54) SWASH PLATE TYPE COMPRESSOR WHEREIN PISTON HEAD HAS INNER SLIDING PORTION FOR REDUCING LOCAL WEAR

(75) Inventors: Takayuki Kato, Kariya (JP); Seiji Katayama, Kariya (JP); Shigeo Fukushima, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/575,471

(22) Filed: May 24, 2000

(30) Foreign Application Priority Data

May 28, 1999 (JP) ..... 11-150448

(51) Int. Cl.[7] ..... F01B 3/00
(52) U.S. Cl. ..... 92/71; 92/172
(58) Field of Search ..... 91/499; 92/71, 92/172

(56) References Cited

U.S. PATENT DOCUMENTS

| | | | | |
|---|---|---|---|---|
| 5,382,139 A | | 1/1995 | Kawaguchi et al. | 417/269 |
| 5,630,353 A | | 5/1997 | Mittlefehldt et al. | 92/71 |
| 5,868,556 A | * | 2/1999 | Umemura | 92/71 |
| 5,941,161 A | * | 8/1999 | Kimura et al. | 92/71 |

FOREIGN PATENT DOCUMENTS

| | | |
|---|---|---|
| DE | 197 54 028 A | 6/1998 |
| EP | 0 809 025 A1 | 11/1997 |
| JP | 06-336977 | 12/1994 |
| JP | A-7-189897 | 7/1995 |
| JP | 07-189900 | 7/1995 |
| JP | A-9-203378 | 8/1997 |

* cited by examiner

*Primary Examiner*—F. Daniel Lopez
(74) *Attorney, Agent, or Firm*—Woodcock Washburn LLP

(57) ABSTRACT

Swash plate type compressor including a cylinder block having cylinder bores arranged along a circle, a drive shaft aligned with the circle, a swash plate rotated with the drive shaft, and single-headed pistons each including a head portion engaging the cylinder bore, and a neck portion engaging the swash plate, and wherein each piston is reciprocated by the swash plate rotated by the drive shaft, and the head portion includes a circular body portion, and an outer sliding portion and an inner sliding portion which are disposed between the body portion and the neck portion and which slidably engage respective circumferential portions of the cylinder bore which correspond to respective radially outer and inner portions of the cylinder block. Length from the end face of the body portion to the remote end of the inner sliding portion is larger than the corresponding length of the outer sliding portion. The inner sliding portion has a distal sliding part spaced from the end face by at least 40% of the entire piston length and having a central angle of not larger than 120° and a length of at least 5% of the entire piston length.

6 Claims, 7 Drawing Sheets

FIG. 5
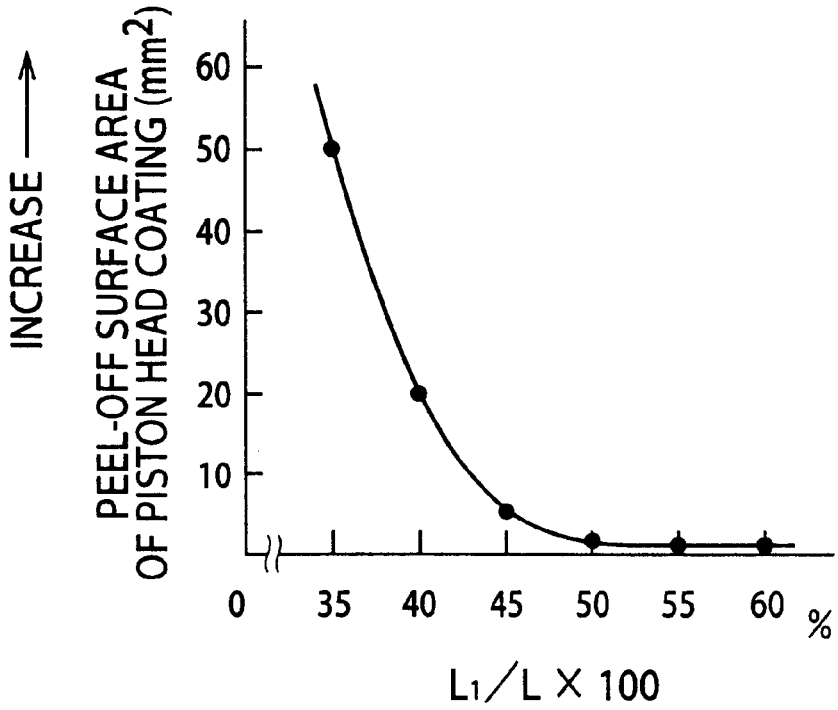
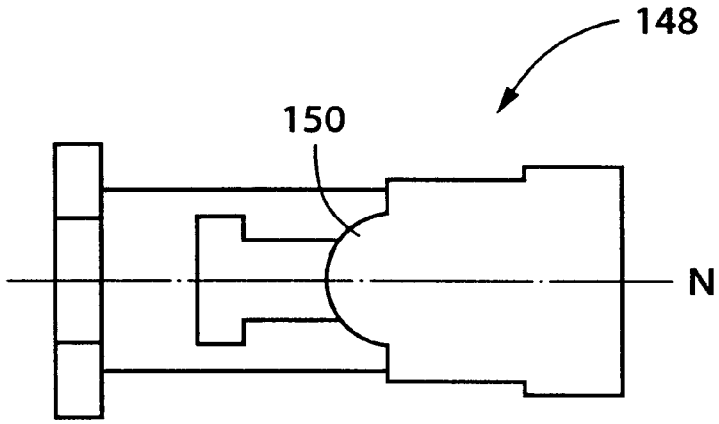
FIG. 6

SWASH PLATE TYPE COMPRESSOR WHEREIN PISTON HEAD HAS INNER SLIDING PORTION FOR REDUCING LOCAL WEAR

This application is based on Japanese Patent Application No. 11-150448 filed May 28, 1999, the content of which is incorporated hereinto by reference.

BACKGROUND OF THE INVENTION

1. Field of the Invention

The present invention relates in general to a swash plate type compressor, and more particularly to the configuration of a single-headed piston of such type of compressor.

2. Discussion of the Related Art

There has been used a swash plate type compressor equipped with a plurality of single-headed pistons. The compressor of this swash plate type includes (1) a cylinder block having a plurality of cylinder bores formed therein such that the cylinder bores are, arranged along a circle, (2) a rotary drive shaft having an axis of rotation aligned with a centerline of the above-indicated circle, (3) a swash plate rotated with the rotary drive shaft, and (4) a plurality of single-headed pistons each of which includes a head portion slidably engaging a corresponding one of said cylinder bores, and a neck portion engaging said swash plate. In this compressor, the pistons are reciprocated by the swash plate rotated with the rotary drive shaft. An example of this swash plate type compressor is disclosed in JP-A-9-203378. In the swash plate type compressor disclosed in this publication, the head portion of each piston is formed with a through-hole substantially parallel to the circumferential direction of the cylinder block, so as to reduce the mass of the piston. As described below, the head portion of the piston has a relatively high sliding surface pressure at two circumferential portions of its outer circumferential surface which correspond to respective circumferential portions of the cylinder bore at respective radially outermost and innermost portions of the cylinder block, and a relatively low sliding surface pressure at circumferential portions of its outer circumferential surface which are intermediate between the above-indicated two circumferential portions in the circumferential direction of the cylinder block. This fact permits the above-indicated through-hole to be formed through the head portion, for the purpose of reducing the mass of the head portion.

However, the swash plate type compressor described above suffers from a problem that the head portion is subject to a local wear and has an insufficient degree of durability due to a tendency of inclination of the pistons within the cylinder bores. Where the outer circumferential surface of the head portion of each piston is coated with a coating film such as a film of polytetrafluoroethylene (PTFE), this coating film is subject to a local wear, and is relatively likely to suffer from a peel-off problem. Reference is made to FIG. 10, wherein a resultant force Fo consisting of an inertial force of a piston 200 and a force based on a pressure of a refrigerant gas in the cylinder bore acts on a swash plate 202 through a hemispherical shoe 201 (one of a pair of hemispherical shoes). The resultant force Fo is balanced with an axial component Fo' of a force Fa which acts on the surface of the swash plate 202 in a direction perpendicular to that surface. The axial component Fo' acts on the piston 200 in a direction parallel to the centerline of the piston 200. A radial component Fb of the force Fa which component Fb acts on the piston 200 in the radial direction of the swash plate 202 is called a side force acting in a direction perpendicular to the centerline of the piston 200. This radial component Fb (more precisely, a resultant force consisting of the radial component Fb and a friction force between the swash plate 202 and the hemispherical shoe 201) is balanced with reaction forces Fc, Fd which the piston 200 receives from the inner circumferential surface of a cylinder bore 204. Since the resultant force Fo increases as the piston 200 is moved to its upper dead point in its compression stroke, the reaction forces Fc, Fd are the largest at a point near the upper dead point. In particular, the reaction force Fc is comparatively large near the upper dead point of the piston 200. Accordingly, the coating film such as the PTFE film formed on the outer circumferential surface of the piston 200 is likely to be locally worn or removed.

SUMMARY OF THE INVENTION

The present invention was made in the light of the background prior art described above. It is therefore an object of the present invention to provide a swash plate type compressor which has an improved degree of durability while reducing the mass of the pistons. This object may be achieved according to any one of the following modes of the present invention, each of which is numbered like the appended claims and depends from the other mode or modes, where appropriate, to indicate and clarify possible combinations of technical features of the present invention, for easier understanding of the invention. It is to be understood that the present invention is not limited to the technical features and their combinations described below, and that any technical feature described below in combination with other technical features may be a subject matter of the present invention, independently of those other technical features.

(1) A swash plate type compressor including:

a cylinder block having a plurality of cylinder bores formed therein such that the cylinder bores are arranged along a circle;

a rotary drive shaft having an axis of rotation aligned with a centerline of the circle;

a swash plate rotated with the rotary drive shaft; and a plurality of single-headed pistons each including a head portion slidably engaging a corresponding one of the cylinder bores, and a neck portion engaging the swash plate, each single-headed piston being reciprocated by the swash plate rotated by the rotary drive shaft, the head portion of each single-headed piston including a body portion having a circular shape in transverse cross section, and an outer sliding portion and an inner sliding portion which are disposed between the body portion and the neck portion, the outer and inner sliding portions slidably engaging respective circumferential portions of an inner circumferential surface of the corresponding cylinder bore which correspond to respective radially outer and inner portions of the cylinder block, and wherein a distance from an end face of the body portion remote from the neck portion to an end of the inner sliding portion on the side of the neck portion is larger than a distance from the end face to an end of the outer sliding portion on the side of the neck portion, and the inner sliding portion has a distal sliding part which is spaced from the end face by a distance of at least 40% of an entire length of the piston in an axial direction of the piston and which has a central angle of not larger than 120°, the distal sliding part having a length which is at least 5% of the entire length of said piston.

In the swash plate type compressor constructed according to the above mode (1) of the invention, the head portion of each piston includes the body portion, the inner sliding portion and the outer sliding portion. The inner sliding portion has the distal sliding part which is spaced from the end face of the body portion by a distance of at least 40% of the entire length of the piston and which has the central angle of not larger than 120° and the length which is at least 5% of the entire length of the piston. This arrangement assures a relatively large distance between the axial positions at which the above-indicated two reaction forces act on the piston. Accordingly, the reaction force Fc corresponding to the given side force Fb can be reduced. Further, the amount of increase of the mass of the piston due to the provision of the inner sliding portion is reduced since the distal length of the distal sliding part and its circumferential dimension (central angle) are minimized to such an extent that assures a surface area of the distal sliding part sufficient to limit its sliding surface pressure to a value not higher than a predetermined upper limit. Accordingly, the durability of the distal sliding part (i.e., the durability of the piston) can be effectively increased while reducing the mass of the piston. Where the distal sliding part is coated with a coating film such as a film of PTFE, the local wear and removal of the coating film can be minimized.

The inner sliding portion may be formed so as to extend from the body portion in the axial direction (such that the outer circumferential surface of the inner sliding portion is continuous with that of the body portion). Alternatively, the inner sliding portion may be formed in spaced-apart relation with the body portion (such that the outer circumferential surface of the inner sliding portion is not continuous with that of the body portion). In the former case, the length or distance from the end face of the body portion to the end of the inner sliding portion on the side of the neck portion is equal to a sum of the axial length of the body portion and the axial length of the inner sliding portion (total axial length of the body portion and the inner sliding portion as measured on the radially inner side of the head portion). In the latter case, the above-indicated distance is larger than the above-indicated sum. The above description applies to the outer sliding portion. Namely, the outer sliding portion may either extend from the body portion, or be formed in spaced-apart relation with the body portion. Further, the relationship described above with respect to the inner sliding portion applies to the relationship between the distance from the end face of the body portion to the end of the outer sliding portion on the side of the neck portion and the sum of the axial lengths of the body portion and the outer sliding portion The distance from the end face of the body portion to the end of the inner sliding portion on the side of the neck portion is made larger than the corresponding distance of the outer sliding portion, in view of a fact that the durability of the piston can be effectively improved by increasing the above-indicated distance of the inner sliding portion rather than the corresponding distance of the outer sliding portion. In this respect, it is noted that the sliding surface pressure at the end portion of the outer sliding portion on the side of the neck portion is maximized at a point of transition from the suction stroke to the compression stroke of the piston, and that the side force at this point of time is based primarily on the inertial force of the piston, and is smaller than the side force in the terminal portion of the compression stroke. Accordingly, it is more effective to increase the above-indicated distance of the inner sliding portion rather than the corresponding distance of the outer sliding surface.

The circumferential dimension (central angle) of the inner sliding portion may be constant over its entire axial length, or may be smaller or larger at its part nearer to the neck portion than at its part near to the body portion. In the latter case, the central angle of the distal sliding part of the inner sliding portion is made smaller or larger than that of the other part (referred to as "proximal sliding part" since it is adjacent or nearer to the body portion of the head portion) of the inner sliding portion. The distal sliding part may be configured such that its central angle is constant over its entire axial length or changes depending upon the axial position. For instance, the central angle of the distal sliding part may decrease continuously or in steps as it extends in the axial direction toward the neck portion. The distal sliding part may be formed integrally with the proximal sliding part, or in spaced-part relation with the proximal sliding part.

The proximal and distal sliding parts may have a suitable shape in transverse cross section, which may be generally defined by an arc and a chord, or by a part of an annulus, or may be crescent or generally rectangular. In other words, the surfaces of the proximal and distal sliding parts of the inner sliding portion which slidably engage the inner circumferential surface of the cylinder bore are required to have shapes which follow the corresponding parts of that inner circumferential surface. However, the surfaces of the proximal and distal sliding parts which are opposed to the outer sliding portion may have any shapes, for instance, may be flat surfaces or concave surfaces. Where these surfaces are concave, the mass of the piston is reduced owing to the concavity. The shapes in transverse cross section may be symmetrical or asymmetrical with respect to a plane which passes the centerline of the piston and the centerline of the cylinder block. As described before, a force of friction between the piston and the swash plate also acts on the piston, so that the direction in which a reaction force produced by the inner circumferential surface of the cylinder bore acts on the piston deviates from the plane passing the centerline of the piston and cylinder block, in a direction determined by the direction of rotation of the swash plate. Accordingly, where the swash plate (drive shaft) is rotated in a predetermined one direction, it is advantageous that the inner sliding portion has an asymmetric shape in transverse cross section such that the inner sliding portion has a larger sliding surface on one side of the above-indicated plane on which the above-indicated reaction force deviates from that plane, than on the other side.

The distal sliding part is spaced from the end face of the body portion by a distance which is at least 40% of the entire length of the piston. Preferably, this distance is at least 43% or 46% of the entire length of the piston. An effect of the distal sliding part to prevent the inclination of the piston relative to the centerline of the cylinder bore increases with an increase in the distance of the distal sliding part from the end face of the body. Where the distal sliding part is formed integrally with the proximal sliding part, the weight of the piston increases with the above-indicated distance. It is further noted that the maximum operating stroke of the piston is determined by the outside diameter and inclination angle of the swash plate. Therefore, the axial position of the distal sliding part is desirably determined by taking into account its effect to prevent the piston inclination, the amount of increase of the piston mass and the operating stroke.

(2) A swash plate type compressor according to the above mode (1) , wherein the central angle of the distal sliding part is not larger than 100°.

While the central angle of the distal sliding part is required to be not larger than 120° according to the above mode (1), this central angle is preferably not larger than 110° or 100°, for effectively reduce the mass of the piston. The mass of the piston can be more effectively reduced when the central angle is 95° or 90° or smaller.

A decrease in the central angle of the distal sliding part increases the sliding surf ace pressure of the distal sling part, but reduces the mass of the piston. Accordingly, the central angle of the distal sliding part is preferably determined by taking into account both the sliding surface pressure and the piston mass. Where the central angle of the distal sliding part is extremely small, for example 20°, the inner sliding portion having this distal sliding part provides some effect to prevent inclination of the piston relative to the centerline of the cylinder bore, as compared with the inner sliding portion which does not have the distal sliding part. In view of this, the central angle of the distal sliding part may be not larger than 85°, 80° or 70°.

(3) A swash plate type compressor according to the above mode (1) or (2), wherein the inner sliding portion includes a wide section disposed. on the side of the body portion, and a narrow section which is disposed on the side of the neck portion and which has a smaller circumferential dimension than the wide section.

The narrow section and the wide section may be respectively the distal sliding part and the proximal sliding part which have been described above.

(4) A swash plate type compressor according to the above mode (1) or (2), wherein the inner sliding portion includes a narrow section disposed on the side of the body portion, and a wide section which is disposed on the side of the neck portion and which has a larger circumferential dimension than the narrow section.

The narrow section and the wide section may be respectively the proximal sliding part and the distal sliding part which have been described above. This arrangement permits effective reduction of the sliding surface pressure while reducing the increase of the mass of the piston due to the provision of the inner sliding portion.

(5) A swash plate type compressor according to any one of the above modes (1)–(4), wherein the length of the distal sliding part is at least 8% of the entire length of the piston.

The axial length of the :distal sliding part is at least 5% of the entire length of the piston according to the principle of the above mode (1) of the present invention. In the above mode (5) wherein this axial length is at least 8% of the entire piston length, the sliding surface pressure of the piston can be further reduced. Where the length of the distal sliding part is at least 10%, 12% or 15% of the entire piston length, the piston can be further effectively prevented from being inclined.

Where the inner sliding portion extends continuously from the body portion in the axial direction, an increase in the axial length of the distal sliding part increases the entire axial length of the inner sliding portion and consequently the mass of the piston, if the axial length of the proximal sliding part is unchanged. Accordingly, the percentage of the axial length of the distal sliding part with respect to the entire piston length is desirably determined by taking account of the effect to reduce the sliding surface pressure of the piston, and the amount of increase in the mass of the piston due to the provision of the inner sliding portion.

(6) A swash plate type compressor including:

a cylinder block having a plurality of cylinder bores formed therein such that the cylinder bores are arranged along a circle;

a rotary drive shaft having an axis of rotation aligned with a centerline of the circle;

a swash plate rotated with the rotary drive shaft; and a plurality of single-headed pistons each including a head portion slidably engaging a corresponding one of the cylinder bores, and a neck portion engaging the swash plate, each single-headed piston being reciprocated by the swash plate rotated by the rotary drive shaft, the head portion of each single-headed piston including a body portion having a circular shape in transverse cross section, and an outer protrusion and an inner protrusion which extend toward the neck portion from respective radially outer and inner portions of the cylinder block and which slidably engage respective circumferential portions of an inner circumferential surface of the corresponding cylinder bore, and wherein a total length of the body portion and the inner protrusion in an axial direction of the piston is at least 45% of an entire length of the piston, the inner extension having a central angle of not larger than 120° in at least a distal end portion thereof which is remote from the body portion and whose axial length is at least 10% of the above-indicated total length, a distance of extension of the inner protrusion from the body portion being larger than that of the outer protrusion.

In the swash plate compressor constructed according to the above mode (6) of the present invention, the outer sliding portion and the inner sliding portion of the head portion are provided in the form of the outer protrusion and the inner protrusion, respectively which extend from the body portion of the head portion in the axial direction toward the neck portion. The head portion including these outer and inner protrusions has a larger strength than the head portion wherein the outer and inner sliding portions are formed in spaced-apart relation with the body portion.

The distal end portion of the inner protrusion whose central angle is not larger than 120° and whose axial length is at least 10% of the total length of the body portion and the inner protrusion corresponds to the distal sliding part described above with respect to the above mode (1). The distal sliding part may be referred to as a sliding distal end part.

(7) A swash plate type compressor including a cylinder block having a plurality of cylinder bores formed therein such that the cylinder bores are arranged along a circle, a rotary drive shaft having an axis of rotation aligned with a centerline of the circle, a swash plate rotated with the rotary drive shaft, and a plurality of single-headed pistons each including a head portion slidably engaging a corresponding one of the cylinder bores, and a neck portion engaging the swash plate, each single-headed piston being reciprocated by the swash plate rotated by the rotary drive shaft, the head portion of each single-headed piston including a body portion having a circular shape in transverse cross section, and an inner sliding portion including (a) an inner protrusion which extends toward the neck portion from a radially inner portion of the cylinder block and which has a proximal inner sliding surface which slidably engages an inner circumferential surface of the corresponding cylinder bore, and (b) a spaced-apart distal sliding part which has a spaced-apart inner sliding surface spaced apart from the inner protrusion, the spaced-apart distal sliding part being spaced from an end face of the body portion remote from the neck portion, by a distance of at least 40% of an entire length of the piston, the spaced-apart distal sliding part having a central angle of not larger than 120° and an axial length which is at least 5% of the entire length of the piston.

In the swash plate type compressor constructed according to the above mode (7), the distal sliding part is the spaced-apart distal sliding part which is spaced from the inner protrusion. For instance, the spaced-apart distal sliding part may be formed on a connecting portion which connects the inner protrusion and the neck portion. The spaced-apart distal sliding part is located at an axial position between the inner protrusion and the neck portion, which axial position is spaced from the end face of the body portion by a distance of at least 40% of the entire piston length, as described above. This mode (7) of the invention provides an increased freedom of design in the position of the spaced-apart distal sliding part.

The above mode (7) may be modified such that the inner protrusion is a connecting portion which does not have the proximal inner sliding surface and which merely connects the spaced-apart distal sliding part and the body portion.

(8) A piston for a swash plate type compressor, said piston having a head portion slidably received in a cylinder bore formed in a cylinder block, and a neck portion engaging a swash plate, the head portion includes:

a body portion having a circular shape in transverse cross section; and an outer sliding portion and an inner sliding portion which are disposed between the body portion and the neck portion, the outer and inner sliding portions slidably engaging respective circumferential portions of an inner circumferential surface of the corresponding cylinder bore which correspond to respective radially outer and inner portions of the cylinder block, and wherein a distance from an end face of the body portion remote from the neck portion to an end of the inner sliding portion on the side of the neck portion is larger than a distance from the end face to an end of the outer sliding portion on the side of the neck portion, and the inner sliding portion has a distal sliding part which is spaced from the end face by a distance of at least 40% of an entire length of the piston in an axial direction of the piston and which has a central angle of not larger than 120°, the distal sliding part having a length which is at least 5% of the entire length of the piston. the each There is also provided a piston for a swash plate type compressor, which is described with respect to any one of the above modes (2)–(7).

BRIEF DESCRIPTION OF THE DRAWINGS

The above and optional objects, features, advantages and technical and industrial significance of this invention will be better understood and appreciated by reading the following detailed description of presently preferred embodiments of the invention, when considered in connection with the accompanying drawings, in which:

FIG. 5 is a graph indicating a relationship between the configuration of the piston and the peel-off surface area of the piston head coating;

FIG. 6 is a bottom plan view of a piston included in a swash plate type compressor according to another embodiment of this invention;

DETAILED DESCRIPTION OF THE PREFERRED EMBODIMENTS

Referring to the accompanying drawings, there will be described presently preferred embodiments of this invention in the form of a swash plate type compressor whose delivery capacity is variable.

Figure 1:
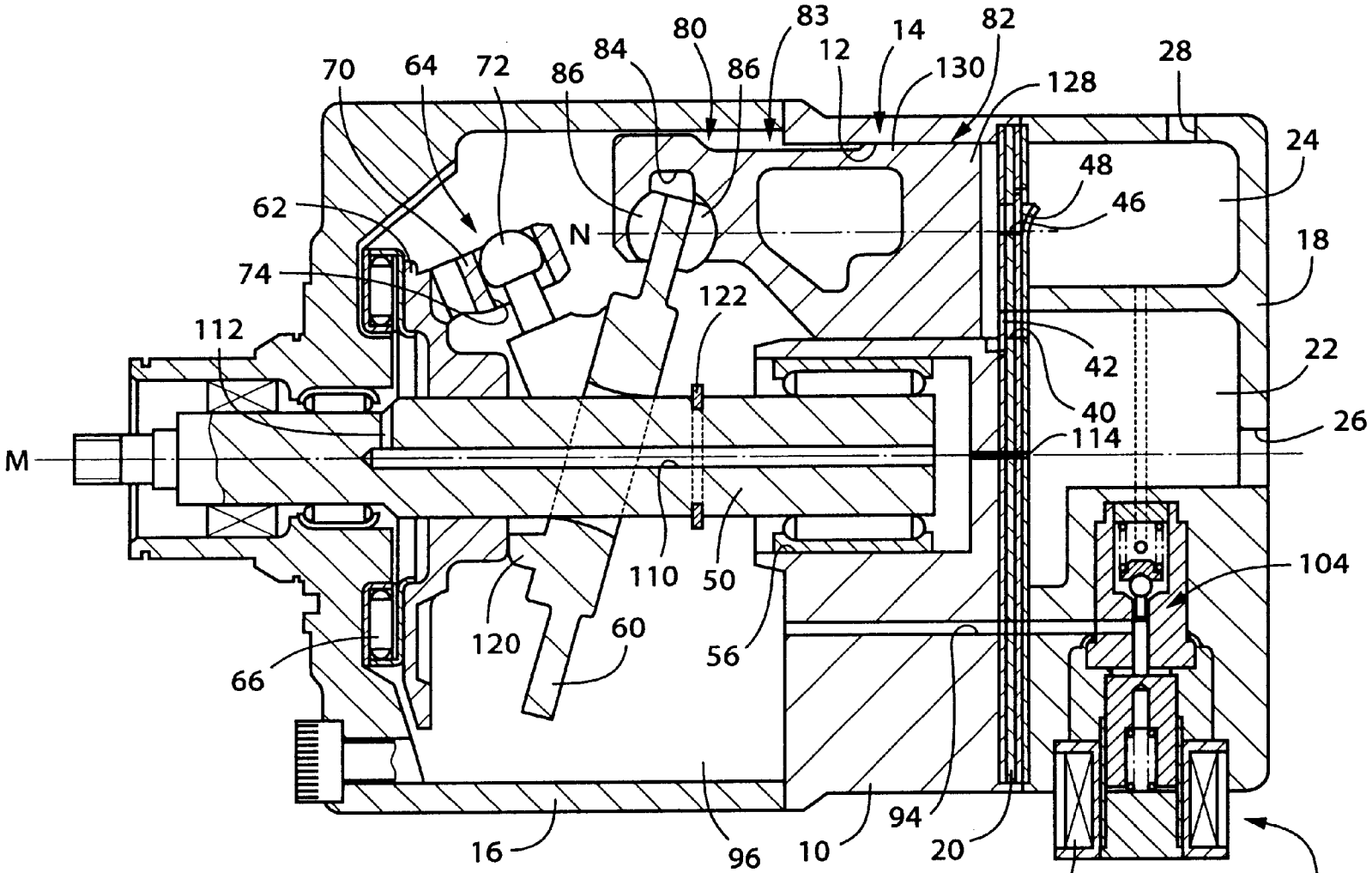
FIG. 1 is a front elevational view in cross section of a swash plate type compressor constructed according to one embodiment of this invention.

In FIG. 1, reference numeral 10 denotes a cylinder block having a centerline M and a plurality of axially extending cylinder bores 12 formed therein such that the cylinder bores 12 are arranged along a circle whose center lies on the centerline M. In each of the cylinder bores 12, there is received a piston 14 such that the piston 14 is axially reciprocable within the cylinder bore 12. To one of axially opposed end faces of the cylinder block 10 (i.e., the left-hand side end face of the cylinder block 10 as viewed in FIG. 1, which will be referred to as "front end face"), there is attached a front housing 16. To the other end face (i.e., the right-hand side end face as viewed in FIG. 1, which will be referred to as "rear end face") of the cylinder block 10, there is attached a rear housing 18 through a valve plate 20. The front housing 16, the rear housing 18 and the cylinder block 10 constitute a major part of a body portion of the swash plate type compressor.

Between the rear housing 18 and the valve plate 20, there are formed a suction chamber 22 and a discharge chamber 24, which are connected to a refrigerating circuit (not shown) through an inlet 26 and an outlet 28, respectively. The valve plate is provided with suction ports 40, suction valves 42, discharge ports 46 and delivery valves 48.

A rotary drive shaft 50 is disposed in alignment with the centerline M of the cylinder block 10 such that the drive shaft 50 is rotatable relative to the cylinder block 10. The drive shaft 50 is supported at its opposite end portions by the front housing 16 and the cylinder block 10 through respective bearings. The cylinder block 10 has a central support hole 56 in a central portion thereof, so that the drive shaft 50 is supported at its rear end portion in the central support hole 56.

To the rotary drive shaft 50, there is attached a swash plate 50 such that the swash plate 60 is movable relative to the drive shaft 50 in the axial direction M of the drive shaft 50 and is tiltable relative to the axis of rotation of the drive shaft 50. To the drive shaft 50, there is also fixed a lug plate 62 such that the lug plate 62 is held in engagement with the swash plate 60 through a hinge mechanism 64. The lug plate 62 is :also held in engagement with a thrust bearing 66 fixed to the front housing 16. The hinge mechanism 64 enables the swash plate 60 to be rotated with the drive shaft 50, and functions to guide the swash plate 60 for the axial movement of the swash plate 60 in the axial direction M and the inclination of the swash plate 60 relative to the drive shaft 50.

The hinge mechanism 64 includes a pair of support arms 70 fixed to the lug plate 62, and guide pins 72 extending from the swash plate 60 such that the guide pins 72 slidably engage guide holes 74 formed in the support arms 70.

The piston 14 includes a neck portion 80 engaging 6 the swash plate 60, a head portion 82 slidably engaging the corresponding cylinder bore 12, and a connecting portion 83 which connects those neck and head portions 80, 82. The neck portion 80 has a groove 84 formed therein, and the swash plate 60 engages the groove 84 through a pair of hemispherical shoes 86. Each shoe 86 has a hemisperical surface which slidably engages a hemispherical portion of the groove 84, and a flat surface which slidably engages the corresponding one of the opposite surfaces of the swash plate 60. The configuration of the piston 14 will be described in detail.

The head portion 82 cooperates with the cylinder block 10 and the valve plate 20 to define a pressurizing chamber 85. A rotary motion of the swash plate 60 is converted into a linear reciprocating motion of the piston 14 through the pair of shoes 86. When the piston 14 is in the suction stroke from the upper dead point to the lower dead point, a refrigerant gas in the suction chamber 22 is fed or admitted into the pressurizing chamber 85 through the suction port 40, with the suction valve 42 being opened under a reduced pressure in the cylinder bore 12. In the compression stroke of the piston 14 from the lower dead point to the upper dead point, the refrigerant gas in the pressurizing chamber 85 is compressed by the piston 14, and the compressed gas is fed into the delivery chamber 46 through the delivery port 46, with the delivery valve 48 being opened under an elevated pressure in the pressurizing chamber 85. As a result of compression of the refrigerant gas in the pressurizing chamber 85, a reaction force acts on the piston 14 in the axial direction. This reaction force is received by the front housing 16 through the piston 14, swash plate 60, lug plate 62 and thrust bearing 66.

Figure 2:
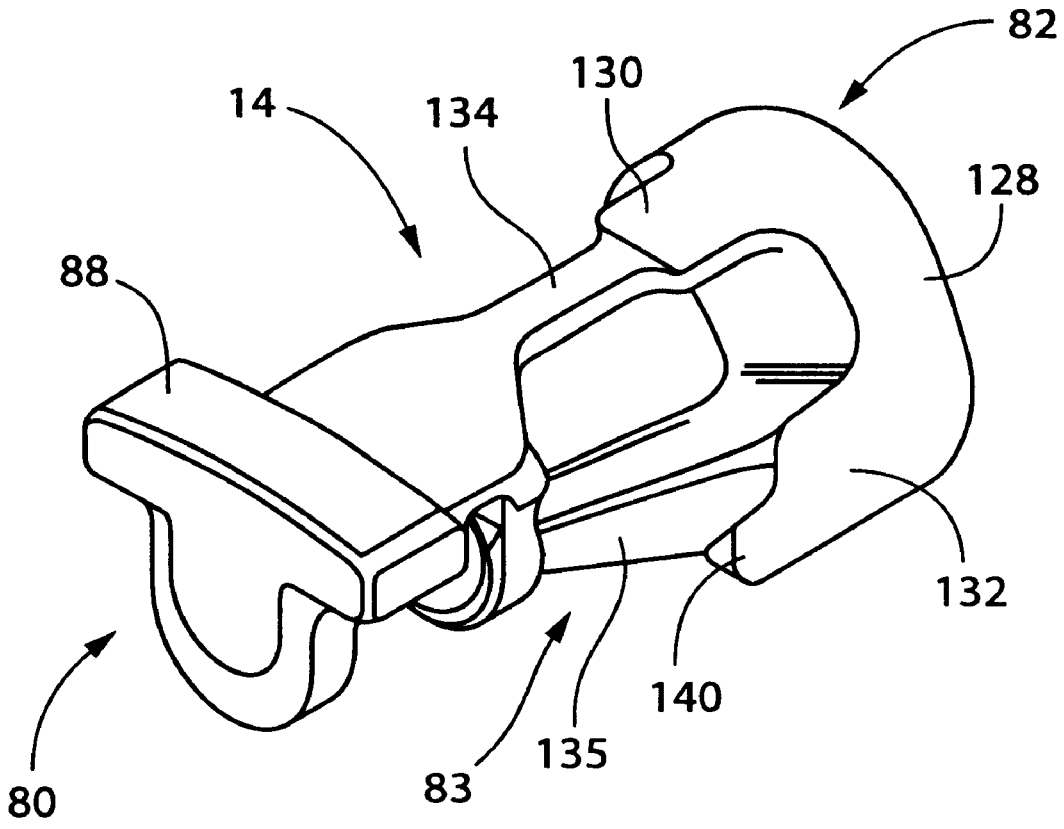
FIG. 2 is a perspective of a piston included in the swash type compressor of FIG. 1.

The neck portion 80 of the piston 14 has an integrally formed rotation preventing portion 88, as shown in FIG. 2. The rotation preventing portion 88 is held in contact with the inner circumferential surface of the front housing 16, for preventing the piston 14 from being rotated about its centerline N.

The cylinder block 10 has a fluid passage 94 formed therethrough, for fluid communication between the delivery chamber 24 and a crank chamber 96 which is formed between the front housing 16 and the cylinder block 10. A portion of the fluid passage 94 is provided by a solenoid-operated control valve 100, which is provided to control the pressure in the crank chamber 96. The solenoid-operated control valve 100 includes a solenoid coil 102, and a shut-off valve 104 which is opened and closed depending upon whether the solenoid coil 102 is placed in an energized state or a de-energized state. The shut-off valve 104 is closed when the solenoid coil 102 is energized, and is opened when the solenoid coil 102 is de-energized.

The rotary drive shaft 50 has an exhaust passage 110 formed therethrough. The exhaust passage 110 is open at one of its opposite ends to the central support hole 56 indicated above, and at the other end to the crank chamber 96 through a communication passage 112. The central support hole 56 is held in communication with the suction chamber 22 through an exhaust port 114, which is formed through the bottom of the central support hole 56 and the valve plate 20.

Upon energization of the solenoid coil 102 of the solenoid-operated control valve 100, the fluid passage 94 is closed, whereby the pressurized refrigerant gas in the discharge chamber 24 is not fed into the crank chamber 96. In this condition, the refrigerant gas in the crank chamber 96 is released into the suction chamber 22 through the exhaust passage 110 and the exhaust port 114, whereby the pressure in the crank chamber 96 is lowered, so that the angle of inclination of the swash plate 60 is increased, resulting in an increase in the rate of change of the volume of the pressurizing chamber 85 and a consequent increase in the discharge capacity of the compressor.

While the fluid passage 94 is open with the solenoid coil 102 placed in the de-energized state, the pressurized refrigerant gas in the discharge chamber 24 is fed into the crank chamber 96, whereby the pressure in the crank chamber 96 is raised, so that the angle of inclination of the swash plate 60 is reduced, resulting in a decrease in the discharge capacity of the compressor. Thus, the present swash plate type compressor is of a variable discharge-capacity type.

The maximum angle of inclination of the swash plate 60 is determined by abutting contact of a stop 120 provided on the swash plate 60, with the lug plate 62. The minimum angle of inclination of the swash plate 60 is determined by abutting contact of the swash plate 60 with a stop 122 in the form of a ring fixed to the drive shaft 50.

It will be understood that the pressure in the crank chamber 96 is controlled by controlling the solenoid-operated control valve 100 so as to selectively connect and disconnect the crank shaft 96 to and from the discharge chamber 24. With the pressure in the crank chamber 96 being changed, the angle of inclination of the swash plate 60 is changed, so that the discharge capacity of the compressor is changed. The operating state of the solenoid coil 102 of the solenoid-operated control valve 100 is controlled by a control device (not shown) principally constituted by a computer, depending upon appropriate input information such as a signal indicative of a load acting on the compressor.

The cylinder block 10 and the piston 14 are formed of suitable aluminum alloys, and the outer circumferential surface of the piston 14 is coated with a coating film of a fluoro resin. The fluoro resin coating prevents the piston 14 from directly contacting the cylinder block 10 whose material is similar to that of the piston 14, making it possible to minimize the amount of gap between the outer circumferential surface of the piston 14 and the inner circumferential surface of the cylinder bore 12. It is noted that the cylinder block 10 and the piston 14 may be formed of suitable hyper-eutectic crystal aluminum silicon alloys. The materials of the cylinder block 10, the piston 14 and the coating of the piston 14 are not limited to those mentioned above by way of example.

Then, the configuration of the piston 14 will be explained.

Figure 3:
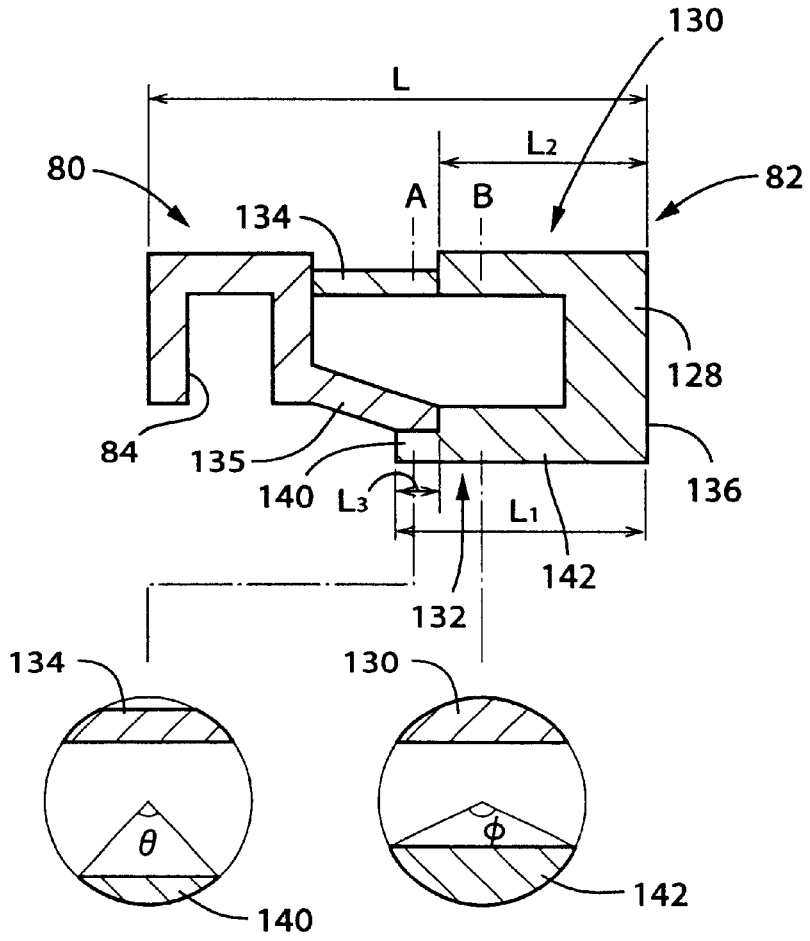
FIG. 3 is a cross sectional view of the piston of FIG. 2.
Figure 4:
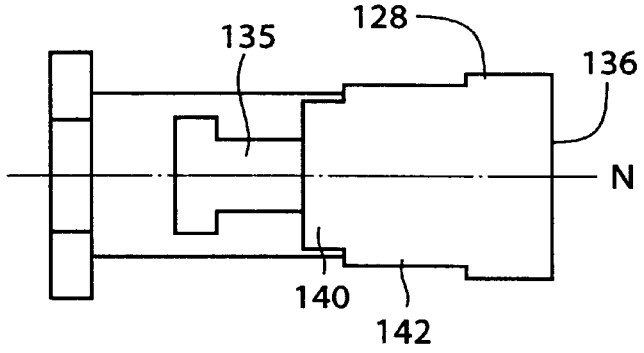
FIG. 4 is a bottom plate view of the piston of FIG. 2.

As shown in FIGS. 2–4, the head portion 82 of the piston 14 includes a body portion 128, an outer sliding portion 130 and an inner sliding portion or protrusion 132 disposed between the body portion 128 and the neck portion 80. The body portion 128 has, a cylindrical shape in transverse cross section, and the outer and inner sliding portions 130, 132 extend from respective circumferential portions of the body portion 128 in the radially outward and inward directions of the cylinder block 10, respectively. The outer and inner sliding portions 130, 132 are provided as outer and inner protrusions from the body portion 128, for sliding contact or engagement with respective circumferential portions of the inner circumferential surface of the cylinder bore 12 which correspond to respective radially outer and inner portions of the cylinder block 10. The inner sliding portion 132 is provided at a circumferential position of the head portion 82 at which the groove 84 of the neck portion 80 is open for engagement with the swash plate 60. The outer sliding portion 130 is connected to the neck portion 80 by a rib 134, while the inner sliding portion 132 is connected to the neck portion 80 by a rib 135. The ribs 134, 135 cooperate to constitute the connecting portion 83 indicated above.

Figure 10:
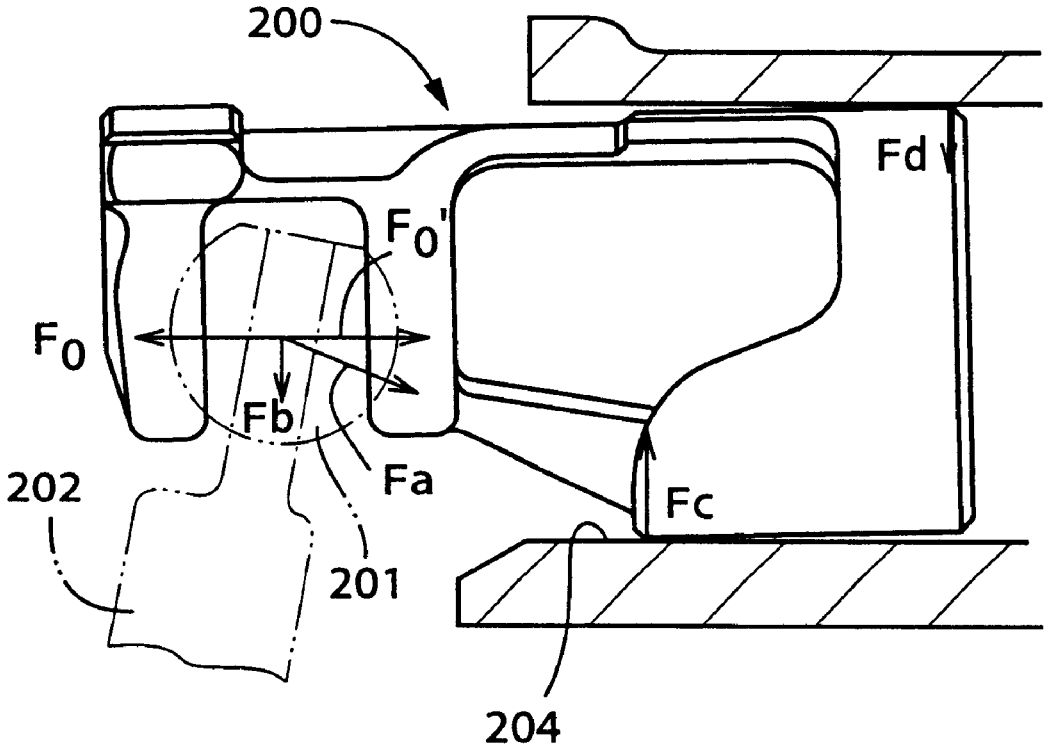
FIG. 10 is a fragmentary elevational view in cross section of a piston in an inclined state in a swash plate type compressor.

In the present embodiment, a total length L1 of the body portion 128 and the inner sliding portion 132 (referred to as "head inner length", which is a length of the head portion 82 as measured at the inner sliding portion 132) is made larger than a total length L2 of the body portion 128 and the outer sliding portion 130 (referred to as "head outer length", which is a length of the head portion 82 as measured at the outer sliding portion 130). Namely, the length L1 from an end face 136 of the body portion 128 (which is remote from the neck portion 80) to the end of the inner sliding portion 132 which is remote from the end face 136 is made larger than the length L2 from the end face 136 to the end of the outer sliding portion 130 remote from the end face 136. By increasing the head inner length L1 rather than the head outer length L2, an axial distance between axial positions at which the reaction forces Fc and Fd act on the piston 14 as indicated in FIG. 10 can be made larger, so that the reaction force Fc can be reduced, provided the side force Fb is constant, whereby the durability of the piston 14 can be effectively improved. It is noted that the piston 14 may be formed by either joining together the head portion 82, neck portion 80 and connecting portion 83 which have been formed as separate members, as shown in FIG. 3, or forming these portions 82, 80, 83 integrally with each other.

A percentage $\alpha(=100\times L1/L)$ of the head inner length L1 with respect to an entire length L of the piston 14 is determined to be 50%. By increasing the length of the inner sliding portion 132, the inclination of the piston 14 relative to the rotation axis M of the drive shaft 50 can be restricted, and the durability of the compressor can be improved. As indicated in the graph of FIG. 5, the amount of wear and the peel-off surface area of the fluoro resin coating of the piston 14 can be significantly reduced, where the above-indicated percentage $\alpha$ is 45%. Although the percentage $\alpha$ is preferably at least 50%, and more preferably at least 55%, as is apparent from the graph, an increase in the head inner length L1 will results in an increase in the weight of the piston 14. It is also noted that the piston 14 has a given operating stroke. Therefore, the head inner length L1 (percentage $\alpha$) is desirably determined with those factors taken into account.

As shown in FIGS. 3 and 4, the configuration of the inner sliding portion 132 in transverse cross section is not uniform in the axial direction. That is, the circumferential dimension of the inner sliding portion 132 as represented by a central angle is smaller at a distal sliding part 140 nearer to the neck portion 80 than at a proximal sliding part 142 nearer to the body portion 128, as indicated at $\Phi$ and $\theta$. Were the central angle $\theta$ of the distal sliding part 140 is made smaller than the central angle $\Phi$ of the proximal sliding part 142, the amount of increase in the weight of the piston 14 due to the provision of the inner sliding part 132 can be made smaller than where these distal and proximal sliding parts 140, 142 have the same central angle ($\theta=\Phi$) or circumferential dimension. Although the sliding surface pressure of the distal sliding part 140 decreases with an increase in the central angle $\theta$, the weight of the piston 14 increases with the central angle $\theta$. Accordingly, it is desirable to determine the central angles $\theta$ and $\Phi$ with the above factors taken into account. However, the central angle $\theta$ of the front sliding part 140 must be 120° or smaller, and is preferably 110° or 100° or smaller. In the present embodiment, the central angle $\theta$ is 90°, while the central angle $\Phi$ of the proximal sliding part 142 is 120°.

The distal sliding part 140 has a length L3 (referred to as "distal length") whose percentage $\beta(=100\times L3/L1)$ with respect to the head inner length L1 is determined to be 20%.

The percentage $\beta$ must be at least 10%, and is preferably at least 15%, 20% or 25%. If the length of the proximal sliding part 142 is fixed, an increase in the percentage $\beta$ increases an effect of preventing the inclination of the piston 14, but increases the eight of the inner sliding portion 132. Accordingly, it is desirable to determine the percentage $\beta$ with these factors taken into account. The distal length L3 may be determined based on a percentage $\gamma$ of this length L3 with respect to the entire length L of the piston 14. In the present piston 14, the percentage $\gamma$ of the distal length L3 with respect to the entire length L is determined to be 10%. The percentage $\gamma$ must be at least 5%, and is preferably at least 8%, 10% or 12%. The axial position of the distal sliding part 140 is determined by the percentage $\alpha$ of the head inner length L1 with respect to the entire length L of the piston 14 and the percentage $\beta$ of the distal length L3 with respect to the head inner length L1). In the present embodiment, the end of the distal sliding part 140 is spaced from the end face 136 of the piston 14 by a distance corresponding to the 40% of the entire length L.

In the present embodiment, the total length (L1–L3) of the body portion 128 and the proximal sliding part 142 is made equal to the head outer length L2 (total length of the body portion 128 and the outer sliding portion 130), as shown in FIG. 3. In this sense, the distal sliding part 140 of the inner sliding portion 132 may be considered to be an extension of the proximal sliding part 142. The total length (L1–L3) need not be equal to the head outer length L2, and may be different from the length L2.

In the present swash plate type compressor constructed as described above, the piston 14 has the distal sliding part 140 so that the distance between the axial positions at which the reaction forces Fc, Fd act on the head portion 82 of the piston 14 can be increased, whereby the reaction force Fc corresponding to the given side force Fb can be reduced. Further, the amount of increase of the mass of the piston 14 due to the provision of the inner sliding portion 132 is reduced since the distal length L3 of the distal sliding part 140 and its central angle $\theta$ are minimized to such an extent that assures a surface area of the distal sliding part 140 sufficient to limit its sliding surface pressure to a value not higher than a predetermined upper limit. Accordingly, the durability of the piston 14 can be effectively increased while reducing the mass of the piston 14. Namely, the local wear and removal of the fluoro resin coating of the distal sliding part 140 can be minimized.

The configuration of the piston 14 is not limited to the details described above with respect to the first embodiment by reference to FIGS. 2–4. For instance, the connecting portion 83 need not include both of the ribs 134, 135, but may consist of only one of these two ribs 134, 145. Similarly, the configuration and size of the distal sliding part 140 are not limited to the details described above with respect to the first embodiment. The distal sliding part 140 may have any configuration and size provided the configuration and size assure an improvement in the durability of the piston 140.

Figure 7:
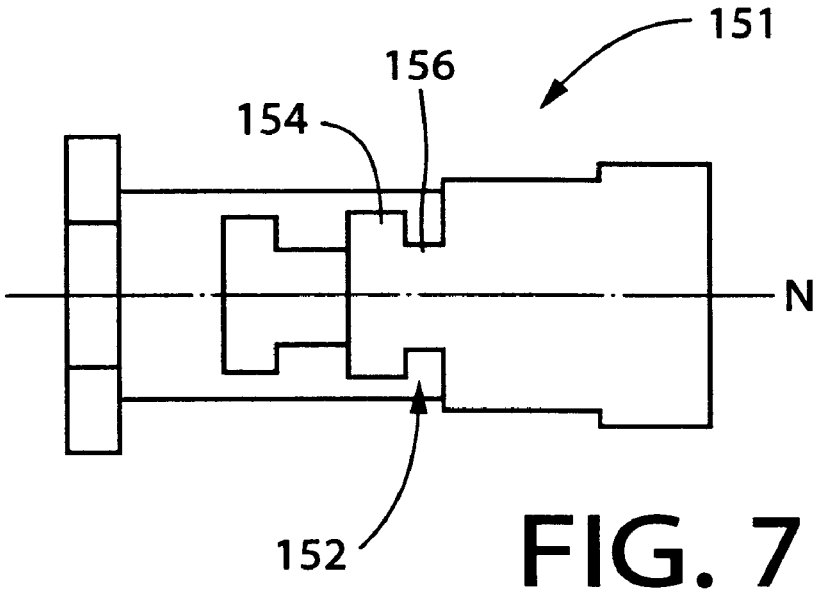
FIG. 7 is a bottom plan view of a piston included in a swash plate type compressor according to a further embodiment of this invention.

FIG. 6 shows a piston 148 according to a second embodiment of this invention, which has a modified distal sliding part as indicated at 150. The distal sliding part 150 has a circumferential dimension and a central angle $\theta$ which continuously decrease as indicated by a curved line in FIG. 6 as the part 150 extends in the axial direction of the piston 148 from the head portion toward the neck portion. FIG. 7 shows a third embodiment wherein a piston 151 has a distal sliding part 152 which consists of a wide section 154 located on the side of the neck portion, and a narrow section 156 located on the side of the head portion. The wide section 154 has a comparatively large central angle and consequently a comparatively large pressure-receiving surface area, which further improves the durability of the piston 151. On the other hand, the narrow section 156 contributes to a decrease in the amount of increase of the weight of the piston 151 due to the provision of the inner sliding part 152, as compared with that of a piston whose inner sliding part consists of only the wide portion 154. Only the wide portion 154 may be considered to be the distal sliding part 154, and the narrow section 156 may be considered to be a part of the proximal sliding part.

Figure 8:
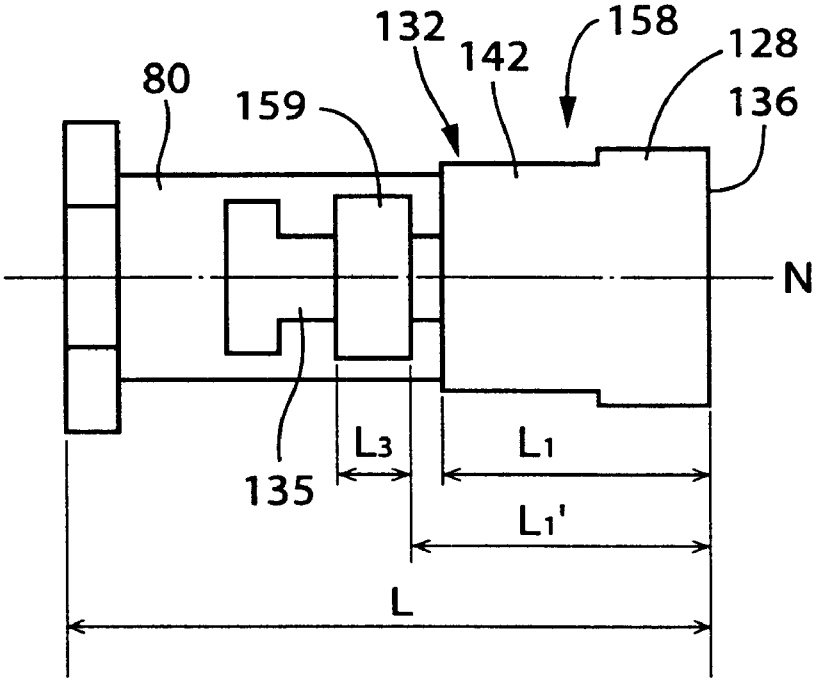
FIG. 8 is a bottom plan view of a piston included in a swash plate type compressor according to a still further embodiment of this invention.

Referring next to FIG. 8, there is shown a fourth embodiment of this invention wherein a piston 158 has a spaced-apart distal sliding part 159 on the rib 135 which connects the proximal part 142 and the neck portion 80. The spaced-apart distal sliding part 159 is spaced from the proximal sliding part 142. In this embodiment, the distal sliding part 159 is spaced from the end face 146 of the body portion 128 by a distance L1' a percentage $\gamma(=100\times L1'/L)$ of which with respect to the entire length L of the piston 158 is determined to be 45%. A head inner length is a sum of the axial length L1 of the proximal sliding part 152 and the axial length L3 of the spaced-apart distal sliding part 159, and a percentage $\{=100\times(L1+L3)/L\}$ of this head inner length with respect to the entire piston length L is determined to be 50%. The provision of the spaced-apart distal sliding part 159 eliminates a need of increasing the axial length of the proximal sliding part 142, so that the weight increase of the piston 158 due to the provision of the inner sliding portion is accordingly reduced. The spaced-apart distal sliding part 159 may be configured such that its central angle continuously changes in the axial direction, along a straight or curved line.

In the preceding embodiments, the central angle (circumferential dimension) of the inner sliding portion 132 decrease in steps at the boundary between the proximal and distal sliding parts, in the direction from the head portion toward the neck portion 80. However, this central angle of the inner sliding portion 132 may continuously decrease at the boundary between the proximal and distal sliding parts. The configuration of the inner sliding portion 132 may be either symmetrical or asymmetrical with respect to a plane which passes the centerline N of the piston 14, 148, 151, 158 and the centerline M of the cylinder block 10.

Figure 9:
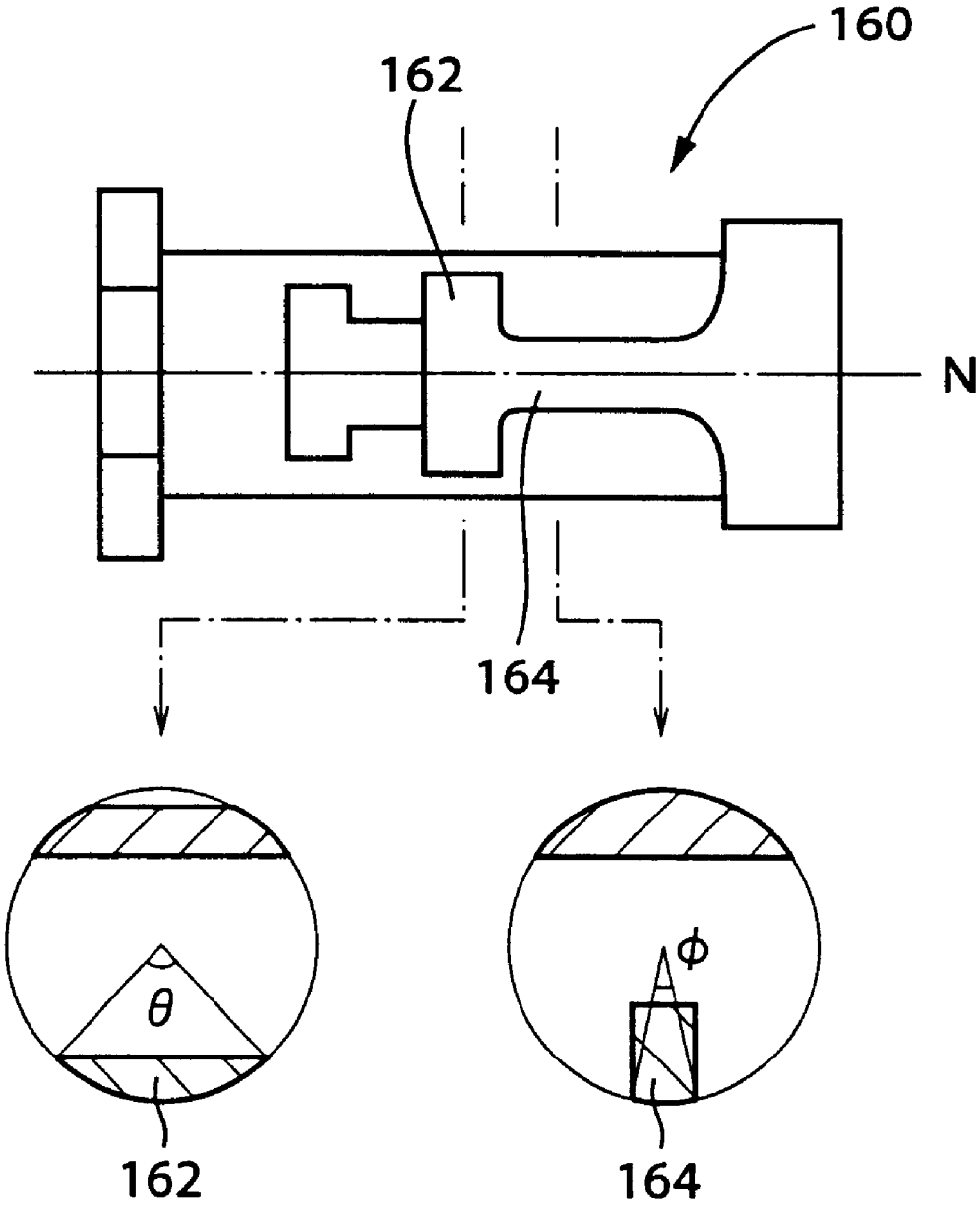
FIG. 9 is a bottom plan view of a piston included in a swash plate type compressor according to a yet further embodiment of this invention.

FIG. 9 shows a piston 160 according to a further embodiment of this invention, wherein the central angle $\theta$ of a distal sliding part 162 is larger than the central angle $\Phi$ of a proximal sliding part 164, contrary to the arrangements in the preceding embodiments. The comparatively larger central angle (circumferential dimension) of the distal sliding part 162 provides a comparatively larger pressure-receiving surface area, which results in an effect of accordingly lowering the sliding surface pressure in the distal sliding part 162. On the other hand, the proximal sliding part 164 does not receive a large reaction force from the inner surface of the cylinder bore, and need not have a pressure-receiving surface area as large as that of the distal sliding part 162. Thus, the present arrangement permits an improved degree of durability of the piston 160 while assuring a reduced weight of the piston. It is noted that the provision of the proximal sliding part 164 is not essential, and that the distal sliding part 162 may be provided on the connecting portion which connects the body portion 128 of the head portion 82 and the neck portion 80.

It is further noted that the various distal sliding parts described above may have suitable shapes in transverse cross section, and that the configuration of the body portion 128 is not limited to that of the illustrated embodiment. For instance, the body portion 128 may have an axially intermediate section which has a smaller diameter than the other axial sections. This arrangement also assures intended compression of the refrigerant gas by the piston, provided an air-tight sliding contact of the piston with the cylinder bore 12 is guaranteed at the opposite end portions of the piston.

The construction of the swash type compressor is not limited to the details of the illustrated embodiments, but may be modified as needed. For example, the solenoid-operated control valve 100 is not essential, and may be replaced by a shut-off valve which is opened and closed depending upon a difference between the pressures in the crank chamber 56 and the suction chamber 24. In any arrangement for controlling the fluid communication between the crank chamber 56 and the suction chamber 24, the angle of inclination of the swash plate 60 is increased to increase the discharge capacity of the compressor, by lowering the pressure in the crank chamber 56.

What is claimed is:

1. A swash plate type compressor comprising:

a cylinder block having a plurality of cylinder bores formed therein such that said cylinder bores are arranged along a circle;

a rotary drive shaft having an axis of rotation aligned with a centerline of said circle;

a swash plate rotated with said rotary drive shaft; and a plurality of single-headed pistons each including a head portion slidably engaging a corresponding one of said cylinder bores, and a neck portion engaging said swash plate, said each single-headed piston being reciprocated by said swash plate rotated by said rotary drive shaft, said head portion of said each single-headed piston including a body portion having a circular shape in transverse cross section, and an outer sliding portion and an inner sliding portion which are disposed between said body portion and said neck portion, said outer and inner sliding portions slidably engaging respective circumferential portions of an inner circumferential surface of said corresponding cylinder bore which correspond to respective radially outer and inner portions of said cylinder block, wherein said inner sliding portion includes a narrow section disposed on the side of said body portion, and a wide section which is disposed on the side of said neck portion and which has a larger circumferential dimension than said narrow section, and wherein a distance from an end face of said body portion remote from said neck portion to an end of said inner sliding portion on the side of said neck portion is larger than a distance from said end face to an end of said outer sliding portion on the side of said neck portion, and said inner sliding portion has a distal sliding part which is spaced from said end face by a distance of at least 40% of an entire length of said piston in an axial direction of said piston and which has a length that is at least 5% of said entire length of said piston and a central angle of not larger than 120°, wherein said central angle is defined by two lines which connect a centerline of said body portion and circumferentially opposite ends of said inner sliding portion as seen in a circumferential direction of said body portion, said central angle of said distal sliding part being different from that of the other part of said inner sliding portion adjacent to said body portion.

2. A swash plate type compressor according to claim 1, wherein said central angle of said distal sliding part is not larger than 100°.

3. A swash plate type compressor according to claim 1, wherein said length of said sliding distal part is at least 8% of said entire length of said piston.

4. A swash plate type compressor comprising:

a cylinder block having a plurality of cylinder bores formed therein such that said cylinder bores are arranged along a circle;

a rotary drive having an axis of rotation aligned with a centerline of said circle;

a swash plate rotated with said rotary drive shaft; and a plurality of single-headed pistons each including a head portion slidably engaging a corresponding one of said cylinder bores, and a neck portion engaging said swash plate, said each single-headed piston being reciprocated by said swash plate rotated by said rotary drive shaft, said head portion of said each single-headed piston including a body portion having a circular shape in transverse cross section, and an inner sliding portion including (a) an inner protrusion which extends toward said neck portion from a circumferential part of said body portion, which part corresponds to a radially inner portion of said cylinder block and which has a proximal inner sliding surface which slidably engages an inner circumferential surface of said corresponding cylinder bore, and (b) a spaced-apart distal sliding part which has a spaced-apart inner sliding surface spaced apart from said inner protrusion, said spaced-apart distal sliding part being spaced from an end face of said body portion remote from said neck portion, by a distance of at least 40% of an entire length of said piston, said spaced-apart distal sliding part having an axial length which is at least 5% of said entire length of said piston and a central angle of not larger than 120°, said central angle being defined by two lines which connect a ceniterline of said body portion and circumferentially opposite ends of said distal sliding part as seen in a circumferential direction of said body portion.

5. A swash plate type compressor comprising:

a cylinder block having a plurality of cylinder bores formed therein such that said cylinder bores are arranged along a circle;

a rotary drive shaft having an axis of rotation aligned with a centerline of said circle;

a swash plate rotated with said rotary drive shaft; and a plurality of single-headed pistons each including a head portion slidably engaging a corresponding one of said cylinder bores, and a neck portion engaging said swash plate, said each single-headed piston being reciprocated by said swash plate rotated by said rotary drive shaft, said head portion of said each single-headed piston including a body portion having a circular shape in transverse cross section, and an outer sliding portion and inner sliding portion which are disposed between said body portion and said neck portion, said outer and an inner sliding portions slidably engaging respective circumferential portions of an inner circumferential surface of said corresponding cylinder bore which correspond to respective radially outer and inner portions of said cylinder block, wherein a distance from an end face of said body portion remote from said neck portion to an end of said inner sliding portion on the side of said neck portion is larger than a distance from said end face to an end of said outer sliding portion on the side of said neck portion, and said inner sliding portion has a distal sliding part which is spaced from said end face by a distance of at least 40% of an entire length of said piston in an axial direction of said piston and which has a length that is at least 5% of said entire length of said piston and a central angle of not larger than 120°, wherein said central angle is defined by two lines which connect a centerline of said body portion and circumferentially opposite ends of said distal sliding part as seen in a circumferential direction of said body portion, said central angle of said distal sliding part being abruptly or steppedly changed from that of the other part of said inner sliding portion adjacent to said body portion, and wherein said central angle of said distal sliding part continuously decreases as said distal sliding part extends in an axial direction of said piston from said head portion toward said neck portion.

6. A swash plate type compressor comprising:

a cylinder block having a plurality of cylinder bores formed therein such that said cylinder bores are arranged along a circle;

a rotary drive shaft having an axis of rotation aligned with a centerline of said circle;

a swash plate rotated with said rotary drive shaft; and a plurality of single-headed pistons each including a head portion slidably engaging a corresponding one of said cylinder bores, and a neck portion engaging said swash plate, said each single-headed piston being reciprocated by said swash plate rotated by said rotary drive shaft, said head portion of said each single-headed piston including a body portion having a circular shape in transverse cross section, and an outer protrusion and an inner protrusion which extend toward said neck portion from respective circumferential parts of said body portion, which parts correspond to respective radially outer and inner portions of said cylinder block and which slidably engage respective circumferential portions of an inner circumferential surface of said corresponding cylinder bore, wherein said inner protrusion comprises a proximal sliding part which is adjacent said body portion, and a distal sliding part which is spaced apart from said body portion, said distal sliding part having a central angle which is different from that of said proximal sliding part, said central angle being defined by two lines which connect a centerline of said body portion and circumferentially opposite ends of said inner protrusion as seen in a circumferential direction of said body portion, and wherein a total length of said body portion and said inner protrusion in an axial direction of said piston is at least 45% of an entire length of said piston, said inner protrusion having said central angle of not larger than 120° in at least said distal sliding part whose axial length is at least 10% of said total length, a distance of extension of said inner protrusion from said body portion being larger than that of said outer protrusion by an amount of at least 5% of an entire length of said piston.

* * * * *